US006019285A

United States Patent [19]

Isobe et al.

[11] Patent Number: 6,019,285

[45] **Date of Patent: *Feb. 1, 2000**

[54] AUTOMATIC TOLL CHARGING SYSTEM AND A VEHICLE-MOUNTED UNIT USED IN THE AUTOMATIC TOLL CHARGING SYSTEM

[75] Inventors: Norihiro Isobe, Tokai; Tomoaki Mizuno, Toyoake, both of Japan

[73] Assignee: Denso Corporation, Kariya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,640

[22] Filed: Mar. 27, 1997

[30] Foreign Application Priority Data

Mar. 28, 1996 [JP] Japan ..... 8-074445

[51] Int. Cl.[7] ..... G07B 15/02

[52] U.S. Cl. ..... 235/384; 235/375; 235/492

[58] Field of Search ..... 235/384, 380, 235/492, 375

[56] References Cited

U.S. PATENT DOCUMENTS

| | | | |
|---|---|---|---|
| 3,705,976 | 12/1972 | Platzman | 235/384 |
| 4,963,723 | 10/1990 | Masada | 235/384 |
| 5,144,553 | 9/1992 | Hassett et al. | 235/384 |
| 5,310,999 | 5/1994 | Claus et al. | 235/384 |
| 5,581,249 | 12/1996 | Yoshida | 235/384 |
| 5,663,548 | 9/1997 | Hayashi et al. | 235/384 |
| 5,675,494 | 10/1997 | Sakurai et al. | 364/464.27 |

FOREIGN PATENT DOCUMENTS

| | | |
|---|---|---|
| 4-248693 | 9/1992 | Japan . |
| 5-324966 | 12/1993 | Japan . |
| 5-324968 | 12/1993 | Japan . |

*Primary Examiner*—Thien Minh Le
*Assistant Examiner*—Daniel St. Cyr
*Attorney, Agent, or Firm*—Pillsbury Madison & Sutro LLP

[57] ABSTRACT

An automatic toll charging system communicates by radio between roadside units disposed on each gate of a toll road and a vehicle-mounted unit mounted in a vehicle, and automatically charges a toll in a range from an entrance gate to an exit gate. In this system, an IC card is inserted in the vehicle-mounted unit , and payment information recorded in the IC card and entrance information received from a roadside unit, disposed at the entrance gate are recorded in the information recording part of the vehicle-mounted unit. In addition, the entrance information recorded in the information recording part is transmitted to the roadside unit disposed at the exit gate, and a toll payment process is executed. The entrance information is recorded in the IC card as a backup so the toll payment process can be executed even if a function of the vehicle-mounted unit is performed improperly.

19 Claims, 5 Drawing Sheets

AUTOMATIC TOLL CHARGING SYSTEM AND A VEHICLE-MOUNTED UNIT USED IN THE AUTOMATIC TOLL CHARGING SYSTEM

CROSS REFERENCE TO THE RELATED APPLICATIONS

This application is based on and claims priority of Japanese Patent Application No. Hei. 8-74445 filed on Mar. 28, 1996, the content of which is incorporated herein by reference.

BACKGROUND OF THE INVENTION

1. Field of the Invention

The present invention relates to an automatic toll charging system which communicates by radio between roadside units disposed at gates of a toll road and a vehicle-mounted unit mounted on a vehicle, and automatically charges a toll in a range from an entrance gate to an exit gate, and also relates to a vehicle-mounted unit used in an automatic toll charging system.

2. Description of Related Art

In recent years, a nonstop automatic toll charging system which automatically charges a toll from a vehicle without stopping has been proposed. This type of system is disclosed in JP-A-4-248693, in which a vehicle-mounted unit holds an IC card as an information recording medium, and at an entrance gate of a toll road (a toll gate at an entrance), the vehicle-mounted unit transmits roadside unit vehicle information (necessary information for verifying the vehicle) retrieved from the IC card. The roadside unit compares the vehicle information with other vehicle information detected by a vehicle type detection apparatus disposed on the roadside unit, and if the result of verification is favorable, the roadside unit transmits entrance information (a passing gate number, time information) to the vehicle-mounted unit in order to make the vehicle-mounted unit record them in the IC card.

The roadside unit verifies the vehicle information by means of the above method at an exit gate of the toll road (a toll gate at an exit). If the result of verification is favorable, the vehicle-mounted unit transmits the entrance information recorded in the IC card to the roadside unit. The roadside unit calculates the toll, and then transmits the toll and the time information to the IC card and a central unit in order to record them as past recorded information in the IC card and the central unit.

As mentioned above, with regard to a two piece type unit in which the IC card can be separated from the vehicle-mounted unit, a toll payment process is completed with information exchanged between the IC card and the roadside unit. In this case, it is necessary to consider two information exchanging steps, where one is executed between the IC card and the vehicle-mounted unit, and the other is executed between the vehicle-mounted unit and the roadside unit, when the information exchanging is executed.

When the nonstop automatic toll charging system is used in practice, it is necessary to transmit the information rapidly so as to ensure the exchange of the information by means of radio communication between the roadside unit and the vehicle. On the one hand, in radio communication between the vehicle-mounted unit and the roadside unit, it is possible to transmit the information with sufficient information transmission speed; on the other hand, between the IC card and the vehicle-mounted unit, it is difficult to transmit the information rapidly because of the limitations of the capabilities of the IC card.

Therefore, as disclosed in JP-A-4-248693, problems due to the difficulties of transmitting the information rapidly arises if the vehicle information and the entrance information are transmitted to the roadside unit from the IC card. Thus, it could be proposed that the information exchanged between the road and the vehicle is basically executed between the vehicle-mounted unit and the roadside unit, and information exchange between the IC card and the vehicle-mounted unit is executed before or after the information exchange between the roadside unit and the vehicle.

In this case, it is important to consider how the entrance information for the toll payment is managed. A method of management by means of a host computer in a central unit or a method of management by means of the vehicle-mounted unit could be proposed. However, the former method is not realistic because it requires a real-time inquiry for the host computer at the exit gate, and loads an information communication network used by the system and the host computer. If the entrance information is held and managed in the vehicle-mounted unit, the later method is realistic because it is possible to execute the calculation and toll payment based on the entrance information at the exit gate. However, if the later method is adopted, when a function of the vehicle-mounted unit goes wrong (it is especially likely that a communication function between the roadside unit and the vehicle-mounted unit may go wrong), it becomes difficult to calculate the toll at the exit gate.

Furthermore, it could be proposed that the IC card be utilized for various purposes in addition to the automatic toll charging system because many functions may be performed by the IC card. In this case, another IC card may be used after passing through the entrance gate because the IC card is not exclusively used by the automatic toll charging system. For instance, another IC card may be used when the IC card is pulled out from the vehicle-mounted unit and used for the payment of a meal at a service area, or when another IC card is used because the original IC card is lost, or when the toll payment is executed by means of a passenger's IC card.

Therefore, with utility of the IC card under consideration, it is convenient that another IC card can be used for the toll payment like the original IC card which is used until the time when the original IC card is exchanged for another IC card even if the original IC card is exchanged for another IC card after passing through the entrance gate.

SUMMARY OF THE INVENTION

In view of the above problems, an object of the present invention is to basically and properly execute an information exchange between the road and the vehicle by means of the vehicle-mounted unit and the roadside unit. Thus, even if a function of the vehicle-mounted unit is improperly performed, calculation of toll can be executed.

Another object of the present invention is to appropriately execute calculation of a toll even if another IC card is used after passing through the entrance gate.

In order to accomplish the above-described objects, a first aspect of the present invention is characterized by recording the entrance information and the payment information in a recording unit of the vehicle-mounted unit, transmitting the entrance information and the payment information from the recording unit to the roadside unit disposed at the exit gate, and also recording the entrance information not only in the recording unit of the vehicle-mounted unit but also in the information recording medium.

Therefore, since the entrance information and the payment information are transmitted not from the information recording medium but from the recording unit to the roadside unit, it is possible to transmit the information rapidly between the vehicle-mounted unit and the roadside unit.

A second aspect of the present invention is characterized by recording the payment information of another information recording medium in the recording unit, and recording the entrance information which is recorded in the recording unit in the other information recording medium as a backup when the information recording medium is exchanged for the other information recording medium after the vehicle passes by the entrance gate.

Therefore, since the other information recording medium can be handled as well as the information recording medium which is exchanged for the other information recording medium, it is possible to appropriately execute calculation of a toll even if the other IC card is used after passing through the entrance gate.

The vehicle mounted-unit preferably transmits the payment information recorded in the recording means to a fourth roadside unit disposed at a passage gate disposed on a flat rate toll road in order to execute a payment process after receiving gate information regarding the toll payment from the fourth roadside unit.

Therefore, it is possible to execute the automatic toll charging regarding not only a variable rate toll road but also the flat rate toll road in which the toll is based on distance between the entrance bate and the exit gate.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

Preferred embodiments of the present invention are described hereinafter with reference to the accompanying drawings.

Figure 1:
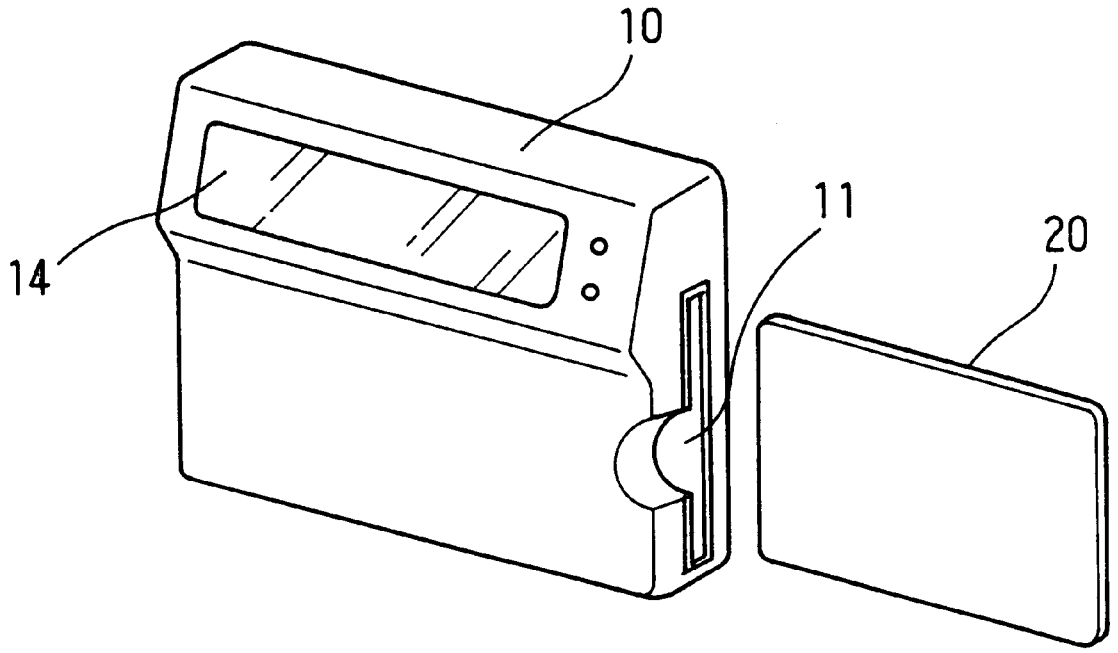
FIG. 1 is a structural view of a vehicle-mounted unit and an IC card according to a preferred embodiment of the present invention.

FIG. 1 shows a external structure of a vehicle-mounted unit 10 and an IC card 20 concerning a first embodiment. In FIG. 1, the vehicle-mounted unit 10 is fixed to the windshield of the vehicle and the IC card 20 is inserted in a insertion port 11 and installed in the vehicle-mounted unit 10. A vehicle-mounted unit which is fixed to a dashboard also may be used.

Figure 2:
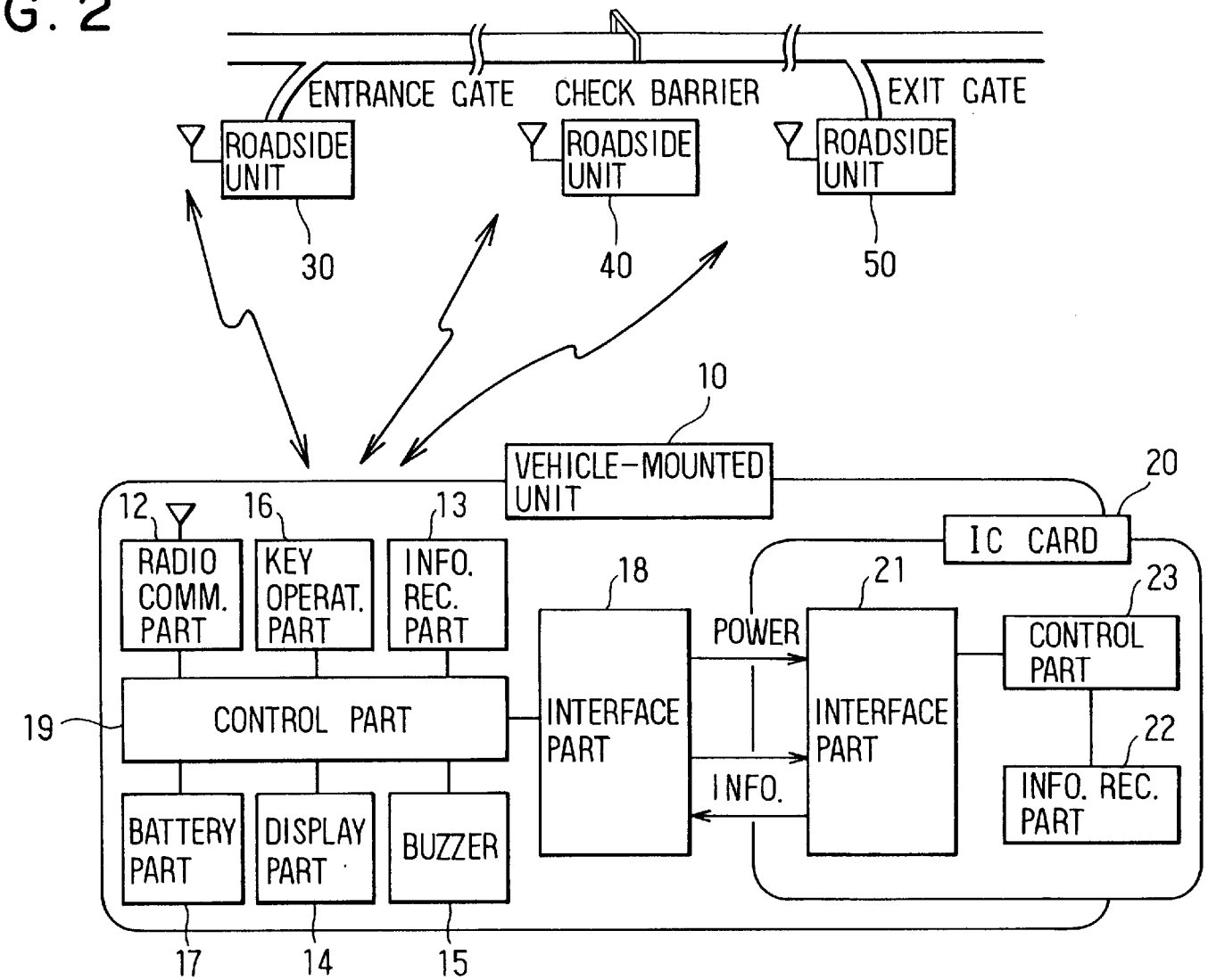
FIG. 2 is a block diagram of an automatic toll charging system according to the embodiment.

FIG. 2 shows a structure of an automatic toll charging system including the vehicle-mounted unit 10, the IC card 20, and roadside units 30–50. The roadside unit 30 is disposed at an entrance gate, the roadside unit 40 is disposed at a check barrier which checks a route of a toll road, and the roadside unit 50 is disposed at an exit gate.

The vehicle-mounted unit 10 includes a radio communication part 12 which communicates with the roadside units by radio, an information recording part 13 which records information used for radio communication with the roadside unit, a display part 14 which displays information from the IC card 20 and other information received from the roadside unit for a user (driver), a buzzer 15 which generates a buzzer sound for alerting the user, a key operating part 16 for executing several actions including discharging the IC card 20, a battery part 17 which supplies each part in the vehicle-mounted unit 10 with power, an interface part 18 for supplying the IC card 20 with the power and for exchanging information, and a control part 19 which controls the vehicle-mounted unit 10. The battery part 17 supplies power from a dry cell or a vehicle-mounted battery.

The following information is recorded in advance in the information recording part 13 of the vehicle-mounted unit 10 as permanent information:

(1) Vehicle information: the vehicle registration number and necessary information for identifying the vehicle (length, weight, number of axles, etc.); and (2) Information of the registered vehicle-mounted unit: the day of registration, the valid period if the registered vehicle-mounted unit has a period of validity , the location of registration, the identification of the person in charge of registration, and the like.

Also, in an operation described later, the following information is recorded in the vehicle-mounted unit 10 as temporary information:

(3) Information regarding the entrance and the exit: the entrance information (the passing gate number, the date and time of passing, etc.) and the route information (the passing gate number, the date and time of passing, etc.); and (4) Information regarding the IC card: the payment information of the IC card, used for a toll payment process.

The IC card 20 includes an interface part 21 for receiving the power and exchanging information, an information recording part 22 which records several types of information regarding the use of the IC card 20, and a control part 23 which executes a procedure regarding reading and writing of the IC card 20.

The following information is recorded in the information recording part 22 of the IC card 20 as permanent information:

(1) Information of the user: the identification number (member's number) regarding the user;

(2) Information of issuance: the issue date, the identification of an issue apparatus, and the identification of the person who issued the IC card 20;

(3) Identification of permitted users of the IC card.

(4) Payment information: the classification regarding a pre-payment or a post-payment, the utilizable balances if the IC card 20 is a pre-payment card, the valid period if the IC card 20 has a valid period, the valid period if the IC card 20 is a post-payment card, the account number of the member, and the like, and (5) Information of past usage record: the past recorded information regarding use of the system.

In the operation described later, the entrance information and the route information are recorded as temporary information.

The vehicle-mounted unit 10 exchanges the information between the vehicle-mounted unit 10 and the roadside units 30–50 by means of radio communication using antennas of each unit.

The roadside unit 30 disposed at the entrance gate distinguishes a type of the passing vehicle by using a vehicle type detection apparatus, and compares the vehicle type information from the vehicle type detection apparatus with other vehicle type information included in the vehicle information received from the passing vehicle; afterwards, it transmits the entrance information to the vehicle-mounted unit 10. The roadside unit 40 disposed at the check barrier transmits the route information to the vehicle-mounted unit 10. The roadside unit 50 disposed at the exit gates compares the above two vehicle types just as the roadside unit 30 compares the above two vehicle types at the entrance gate, and transmits the exit information to the vehicle-mounted unit 10, and then receives the entrance information, the route information, and the payment information; thereafter it executes the toll payment process.

These roadside units 30–50 are electrically connected to a host computer disposed in a central unit, and the host computer records and manages the past recorded information regarding the vehicle traffic based on the information from transmitted the roadside units.

Next, the mode of operation of the above structure will be described.

Figure 3:
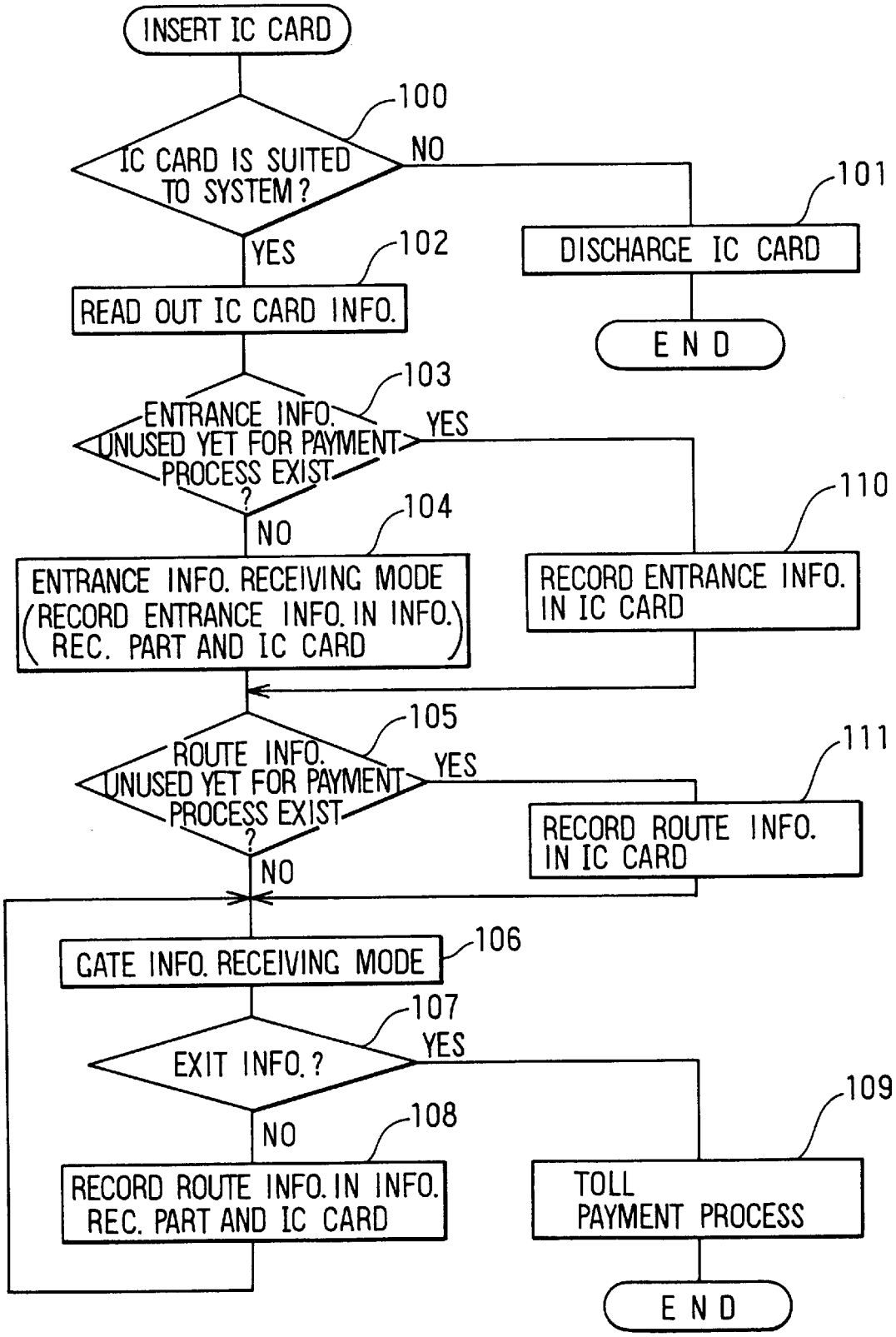
FIG. 3 is a flowchart showing processing of a control unit in the vehicle-mounted unit according a first embodiment.

The vehicle-mounted unit 10 receives power from the battery part 17 and becomes activated. In this condition, when the IC card 20 is inserted in the insertion port 11 of the vehicle-mounted unit 10, a card insertion switch (not shown) which detects the insertion of the IC card 20 optically or mechanically becomes turned on, and the control part 19 executes a process indicated in FIG. 3.

First of all, Step 100 determines based on the identification of permitted users of the IC card recorded in the information recording part 22 of the IC card 20 whether or not the IC card 20 inserted in the insertion port 11 is suitable for the toll collection system. Step 101 executes a process for discharging the IC card 20 if the IC card 20 is not a suitable card. For example, if an automatic discharge mechanism is installed in the vehicle-mounted unit 10, the automatic discharge mechanism discharges the IC card 20 automatically; otherwise, the buzzer 15 generates the buzzer sound and the display unit 14 indicates discharging of the IC card 20. If the inserted IC card 20 is a suitable card, Step 102 reads out the payment information recorded in the information recording part 22 of the IC card 20, and temporarily records it in the information recording part 13.

Next, Step 103 determines whether or not there is entrance information which has not yet been used for the payment process. This determination is used for determining whether or not another IC card is inserted after the vehicle passes through the entrance gate and records the entrance information. The result of the determination is "NO" right after the IC card 20 is inserted, after which Step 104 receives the entrance information.

In the mode of receiving the entrance information, Step 104 at first transmits the vehicle information to the entrance gate and next receives the entrance information which is transmitted after the roadside unit 30 verifies the vehicle type. Then, it records the entrance information in the information recording part 13 and also records it in the information recording part 22 of the IC card 20 as a backup.

When the process of receiving the entrance information is finished, Step 105 determines whether or not there is route information which has not yet been used for the payment process. This determination is used for determining whether or not a situation where another IC card is inserted after the vehicle passes through the check barrier and records the route information has occurred. If the same IC card is inserted from the time the vehicle has not passed through the entrance gate yet, the result of the determination is "NO", after which Step 106 receives the gate information.

In the mode of receiving the gate information, Step 106 receives gate information from a roadside unit disposed at a gate other than the entrance gate. If the gate information is not the exit information, the determination of Step 107 becomes "NO", then Step 108 records the route information in the information recording part 13, and also records it in the information recording part 22 of the IC card 20 as a backup.

If the gate information is the entrance information, Step 109 executes the toll payment process. In this toll payment process, the vehicle-mounted unit 10 transmits the entrance information, the route information, the payment information, and necessary information for toll payment process, which are temporarily recorded in the information recording part 13 to the roadside unit 50. The roadside unit 50 calculates the toll, based on that information. If the IC card 20 is an pre-payment card, the roadside unit 50 relays the toll to the vehicle-mounted unit 10. If the IC card 20 is a post-payment card, the roadside unit 50 relays the receipt of the above information to the vehicle-mounted unit 10; thereafter, the roadside unit 50 makes the vehicle-mounted unit 10 record the toll, the entrance information, and the route information as past recorded information in the IC card 20. If the IC card 20 is an pre-payment card, the IC card 20 executes a toll balance process. Also, in this payment process, the entrance information and the route information recorded in the information recording part 13 are regarded as the toll payment information.

Herein, if some communication function between the roadside unit 50 and the vehicle-mounted unit 10 is improperly performed, it is impossible to calculate the toll at the exit gate. However, in this embodiment, since the entrance information and the payment information are recorded in the IC card 20 as a backup, if an exclusive payment apparatus disposed at the exit gate is used to read out the entrance information and the payment information, the toll payment and the record of the past recorded information can be executed based on the information recorded in the IC card 20 as a backup.

The same IC card is used in a range from the entrance gate to the exit gate in the above embodiment; in addition, there are some other cases in which the IC card is exchanged for another IC card during traveling after passing through the entrance gate. For instance, one case is that another IC card is adopted because of the loss of the original IC card during shopping at a service area, or another case is that the IC card is exchanged for a passenger's IC card.

Here, if another IC card is inserted in the vehicle-mounted unit 10 during traveling, when the process comes to Step 102 from Step 100, Step 102 reads out the payment information recorded in the other IC card and records it in the information recording part 13. Because the entrance information has been recorded in the information recording part 13, the result of the determination becomes "YES" when the process comes to Step 103, and Step 110 writes the entrance information recorded in the information recording part 13 into the information recording part 22 of another IC card 20. Also, if the route information has been already recorded, the determination of Step 105 is "YES", and Step 111 writes the route information recorded in the information recording part 13 into the information recording part 22 of the other IC card.

According to these processes, another IC card can be used as well as the original IC card. That is to say, the payment process can be executed by using the payment information of another IC card. If some communication function between the roadside unit 50 and the vehicle-mounted unit 10 is improperly performed, the toll payment and the record of the past recorded information are executed by means of another IC card because the entrance information and the route information are recorded in the other IC card as a backup.

The first embodiment describes a toll charging system applied to a variable rate toll road in which a toll is based on the distance between the entrance gate and the exit gate. A second embodiment will describe a toll charging system applied to not only the variable rate toll road but a flat rate of toll road.

Figure 4:
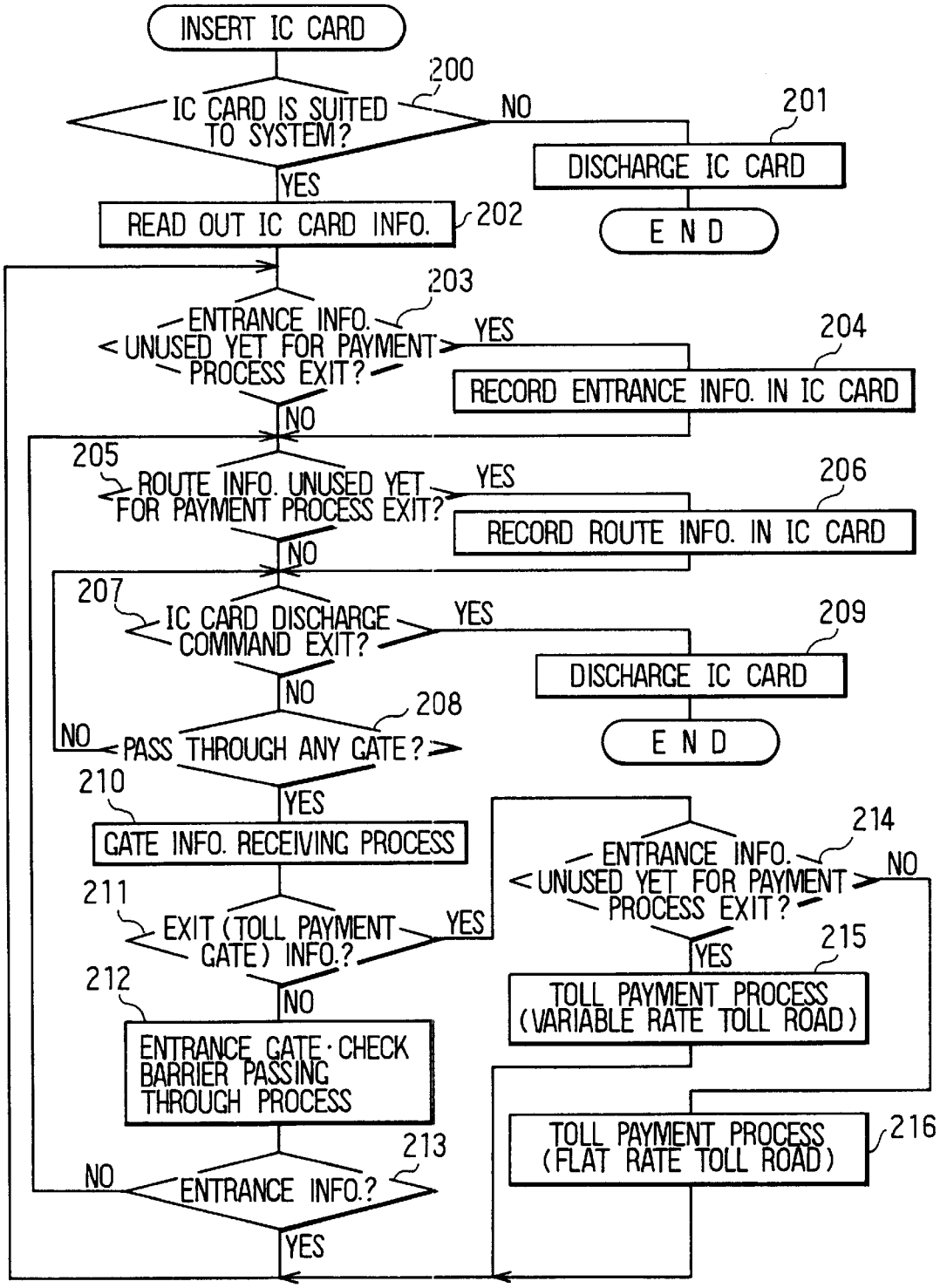
FIG. 4 is a flowchart showing processing of a control unit in the vehicle-mounted unit according a second embodiment.

In this second embodiment, an operation of the vehicle-mounted unit 10 will be described in a flowchart shown in FIG. 4. In FIG. 4, Steps 200–203 execute the same process as the process shown Steps 100–103 in FIG. 3. Next, Step 205 determines whether or not there is route information which has not yet been used for the payment process. The result of the determination is "NO" right after the IC card is inserted. After that, Step 207 determines whether or not the key operating part 16 is instructing discharge of the IC card. If the key operating part 16 is instructing discharge of the IC card, Step 209 executes a process for discharging the IC card. If the key operating part 16 does not instruct discharge of the IC card, Step 208 determines whether or not the vehicle is passing through any gate. The process of Step 207 and Step 208 is repeated until the vehicle gets to any gate.

When the vehicle gets to a gate and receives a signal, for instance, a request signal regarding vehicle information transmitted from the roadside unit disposed at the gate, the determination of Step 208 is "YES". Thereafter, Step 210 communicates with the roadside unit and executes the process of receiving gate information transmitted from the roadside unit. Step 211 determines whether or not gate information, for instance, the exit information or the information regarding a passage gate constructed on the flat rate toll road, received from the roadside unit pertains to the toll payment. If the gate information received from the roadside unit does not pertain to the toll payment, Step 212 regards the information received from the roadside unit as the entrance information or the route information transmitted from another roadside unit disposed at check a barrier, and Step 212 records it in the information recording part 13.

Next, Step 213 determines whether or not the information recorded in the information recording part 13 is the entrance information. If the vehicle travels on the variable rate toll road, the first determination of Step 213 is "YES" because the vehicle-mounted unit receives the entrance information from the roadside unit 30 at first when the vehicle enters the variable rate toll road and next, the determination of Step 203 is "YES" because the entrance information has been already recorded in the information recording part 13. Then, Step 204 records the entrance information in the information recording part 22 of the IC card 20 as a backup.

The process of Steps 207–208 is repeated after the process of Step 205, and when the vehicle gets to the check barrier, the determination of Step 208 is "YES" and Step 210 receives the route information from the roadside unit disposed at the check barrier. Step 212 records the route information in the information recording part 13 after the process of Step 211. Next, Step 213 determines whether or not the information recorded in the information recording part 13 is the entrance information. In this case, the determination of Step 213 is "NO" because the route information recorded in the information recording part 13 by Step 212 just before is not the entrance information; and next the determination of Step 205 is "YES" after the process of Step 203 because the route information which has not been used for payment process yet has been already recorded in the information recording part 13; thereafter, Step 206 records the route information in the information recording part 22 of the IC card 20 as a backup.

After that, the process of Steps 207–208 are repeated again, and when the vehicle gets to the exit gate, the determination of Step 208 is "YES" and Step 210 receives the exit information from the roadside unit disposed at the exit gate. Next, determination of Step 211 is "YES" because the exit information has been already received, and Step 214 determines whether or not the entrance information which has not yet been used for a payment process is recorded in the information recording part 13. In this case, the determination of Step 214 is "YES" because the entrance information which has not yet been used for a payment process has been already recorded by Step 204, and Step 215 executes the toll payment process regarding the variable rate type toll road like Step 109 in FIG. 3.

With regard to not only the first embodiment but also this second embodiment, if some communication function between the roadside unit 50 and the vehicle-mounted unit 10 is improperly performed, the toll payment and the record of the past recorded information are executed by means of an exclusive payment apparatus disposed at the exit gate, provided that the entrance information and the route information are recorded in the IC card 20 as a backup.

Furthermore, when the IC card is exchanged for another IC card after passing through the entrance gate, Step 204 records the entrance information recorded in the original IC card in the other IC card if the entrance information which has not been used for a payment process yet is recorded in the information recording part 13, and Step 206 records the route information recorded in the original IC card in the other IC card if the route information which has not yet been used for a payment process is recorded in the information recording part 13. Therefore, the toll payment and the record of the past recorded information are executed by means of another IC card like the first embodiment.

Figure 5:
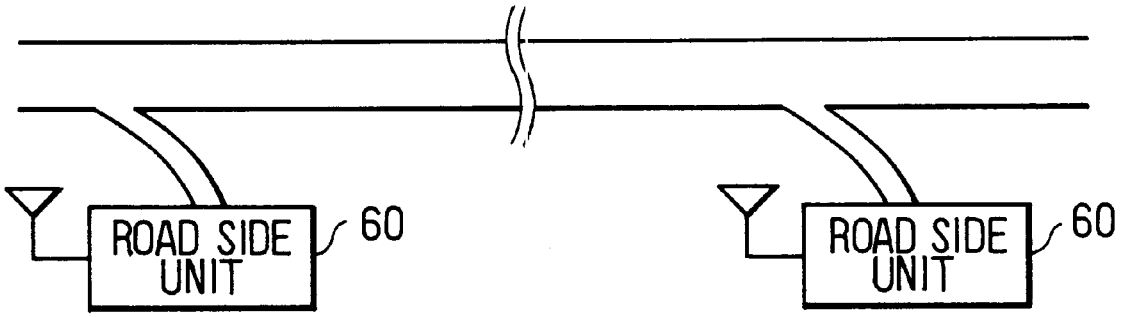
FIG. 5 is a structural view showing the situation of roadside units 60 disposed on a flat rate toll road.

Next, in cases where the vehicle travels on a flat rate toll road, an operation of the vehicle-mounted unit 10 will be described as follows. As shown in FIG. 5, a roadside unit 60 is disposed at each passage gate disposed on the flat rate toll road.

When the vehicle gets to the passage gate disposed on the flat rate toll road, Step 208 determines the vehicle is passing through the passage gate disposed on the flat rate toll road, and Step 210 receives the gate information regarding the toll payment from the roadside unit 60. In this case, the roadside unit 60 transmits the gate information regarding the payment process to the vehicle-mounted unit 10 after executing the process of vehicle verification based on the vehicle information transmitted from the vehicle-mounted unit 10. Therefore, the determination of Step 211 is "YES" because the gate information regarding the toll payment has already been received from the roadside unit 60 by Step 211. Next, the determination of Step 214 is "NO" because in this case, the entrance information is not recorded in the information recording part 13, and Step 216 executes the process of toll payment regarding the flat rate toll road. In this payment process, the payment information and necessary information for the payment process, for instance, the vehicle information, are transmitted to the roadside unit 60. The roadside unit 60 calculates the toll based on that information. If the IC card 20 is a pre-payment card, the roadside unit 60 relays the toll to the vehicle-mounted unit 10. If the IC card 20 is a post-payment card, the roadside unit 60 relays the receipt of the above information to the vehicle-mounted unit 10; thereafter, the roadside unit 60 makes the vehicle-mounted unit 10 record the toll, the passing gate number, and the date and time of passage as past recorded information in the IC card 20.

Therefore, even if the vehicle travels on the flat rate toll road, the automatic toll charging can be executed by means of the IC card 20. Furthermore, when the vehicle travels on the variable toll road or the flat rate toll road with the IC card inserted, the automatic toll charging can be continuously executed because the process of Step 203 is executed again after Step 215 or Step 216 has executed the payment process.

Another recording medium which has the same function as the IC card can be used available as an information recording medium instead of the IC card which is described in the above embodiment.

In addition to the above embodiments, it is possible to adopt the following embodiment. A button for recording the entrance information in the IC card 20 is disposed on the vehicle-mounted unit 10. The vehicle-mounted unit 10 temporarily records the entrance information in the information recording part 13 when the vehicle-mounted unit 10 receives the entrance information from the roadside unit 30 at the entrance gate. Thereafter, when the button is pushed, the entrance information is transmitted from the information recording part 13 to the IC card 20.

The present invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended be embraced therein.

What is claimed is:

1. An automatic toll charging system for automatically charging a toll in a range from an entrance gate to an exit gate, said system comprising:

a detachable information recording medium to record payment information regarding a toll payment;

roadside units disposed at gates of a toll road, said roadside units including a first roadside unit disposed at said entrance gate, to transmit entrance information, and a second roadside unit disposed at said exit to receive said entrance information and said payment information; and a vehicle-mounted unit mounted on a vehicle, to communicate by radio between said roadside units and said vehicle-mounted unit, said vehicle-mounted unit including recording part, different than said detachable recording medium, to record said entrance information received from said first roadside unit when said vehicle passes through said entrance gate, and said payment information recorded in said information recording medium, and controller to transmit said entrance information and said payment information both recorded in said recording part to said second roadside unit when said vehicle passes through said exit gate, and to record said entrance information as a backup in said information recording medium;

wherein said detachable information recording medium is installed in said vehicle-mounted unit; and wherein said vehicle-mounted unit includes an interface, signal transmission between said controller and said detachable information recording medium is carried out via said interface and said signal transmission between said controller and said recording part is directly performed.

2. An automatic toll charging system according to claim 1, wherein:

said recording part records vehicle information regarding verification of said vehicle;

said vehicle-mounted unit transmits said vehicle information to said first and second roadside units when said vehicle passes through said entrance gate and said exit gates; and said roadside unit verifies a passing vehicle based on said vehicle information.

3. An automatic toll charging system according to claim 1, wherein said entrance information includes a passing gate number and date and time of passing.

4. An automatic toll charging system according to claim 1, wherein said controller determines whether or not the information recording medium is suitable for said toll charging after said information recording medium is installed in said vehicle-mounted unit.

5. An automatic toll charging system according to claim 1, wherein said controller determines whether or not there is entrance information which has not yet been used for said payment process in said recording part.

6. An automatic toll charging system according to claim 5, wherein said controller records said entrance information which has not yet been used for said payment process in said information recording medium as a backup if there is route information which has not yet been used for said payment process in said recording part.

7. An automatic toll charging system according to claim 1, further comprising:

a third roadside unit disposed at a check barrier for checking a route of said vehicle along said toll road, and for transmitting route information to said vehicle-mounted unit when said vehicle passes through said check barrier;

wherein said recording part records said route information transmitted from said third roadside unit, and said controller transmits said route information recorded in said recording part to said second roadside unit disposed at said exit gate when said vehicle passes through said exit gate.

8. An automatic toll charging system according to claim 7, wherein said controller determines whether or not there is route information which has not yet been used for said payment process in said recording part.

9. An automatic toll charging system according to claim 8, wherein said vehicle-mounted unit records said route information which has not yet been used for said payment process in said information recording medium as a backup if there is route information which has not yet been used for said payment process in said recording part.

10. An automatic toll charging system according to claim 1, further comprising:

a third roadside unit disposed at a passage gate disposed on a flat rate toll road, for transmitting gate information regarding said toll payment to said vehicle-mounted unit, and for receiving said payment information from said vehicle mounted-unit;

wherein said vehicle mounted-unit transmits said payment information recorded in said recording part to said third roadside unit in order to execute a payment process after receiving said gate information regarding said toll payment.

11. An automatic toll charging system according to claim 1, wherein said detachable information recording medium is a smart card.

12. A vehicle-mounted unit used in an automatic toll charging system for communicating by radio between roadside units disposed at each gate of a toll road and said vehicle-mounted unit mounted on a vehicle, for automatically charging a toll in a range from an entrance gate to an exit gate, and for receiving a detachable information recording medium which records payment information regarding a toll payment, said vehicle-mounted unit comprising:

communication means for communicating by radio between said vehicle-mounted unit and said roadside units;

recording means for recording entrance information and payment information both used for said radio communication between said vehicle-mounted unit and said roadside units, said recording means being different than said detachable information recording medium; and control means for receiving entrance information transmitted from a first roadside unit disposed at said entrance gate of said toll road via said radio communication means, for recording said payment information recorded in said information recording medium and said entrance information in said recording means, for recording said entrance information in said information recording medium as a backup, and for transmitting said payment information and said entrance information both recorded in said recording means to a second roadside unit disposed at said exit gate of said toll road using said radio communication means wherein said vehicle-mounted unit includes an interface, signal transmission between said control means and said detachable information recording medium is carried out via said interface and signal transmission between said control means and said record means is directly performed.

13. A vehicle-mounted unit used in an automatic toll charging system according to claim 12, wherein said control means records payment information of another information recording medium in said recording means, and also records said entrance information recorded in said recording means in said other information recording medium as said backup when said other information recording medium is installed instead of said information recording medium after said vehicle passes through said entrance gate.

14. A vehicle-mounted unit used in an automatic toll charging system according to claim 13, wherein said control means further comprises:

first determining means for determining whether or not said entrance information recorded in said recording means should be recorded in said other information recording medium as said backup;

wherein said control means records said entrance information recorded in said recording means in said other information recording medium as said backup based on a determination of said first determining means.

15. A vehicle-mounted unit used in an automatic toll charging system according to claim 14, wherein:

said entrance information recorded in said recording means indicates whether or not said entrance information is used for said toll payment; and said first determining means determines whether or not said entrance information which has not yet been used for said toll payment is recorded in said recording means.

16. A vehicle-mounted unit used in an automatic toll charging system according to claim 12, wherein said control means further comprises first determining means for determining whether or not said information recording medium is suitable for said toll charging after said information recording medium is installed in said vehicle-mounted unit.

17. A vehicle-mounted unit used in an automatic toll charging system according to claim 16, further comprising:

a display for displaying information regarding said information recording medium;

discharging means for discharging said information recording medium from said vehicle mounted unit;

wherein said display displays discharging of said installed information recording medium if said first determining means determines said information recording medium which is installed in said vehicle-mounted unit is not suitable for toll charging; and said discharging means discharges said information recording medium from said vehicle mounted unit after said display displays discharging of said installed information recording medium.

18. A vehicle-mounted unit used in an automatic toll charging system according to claim 16, further comprising audio warning generating means for generating a buzzer sound for alerting a user if said first determining means determines said information recording medium which is installed in said vehicle-mounted unit is not suitable for toll charging.

19. A vehicle mounted unit according to claim 11, wherein said detachable information recording medium is a smart card.

* * * * *